US011111724B2

(12) United States Patent
Pacetti

(10) Patent No.: US 11,111,724 B2
(45) Date of Patent: Sep. 7, 2021

(54) LADDER TOOL STORAGE KIT

(71) Applicant: Matthew Pacetti, Bonita Springs, FL (US)

(72) Inventor: Matthew Pacetti, Bonita Springs, FL (US)

( * ) Notice: Subject to any disclaimer, the term of this patent is extended or adjusted under 35 U.S.C. 154(b) by 0 days.

(21) Appl. No.: 16/689,172

(22) Filed: Nov. 20, 2019

(65) Prior Publication Data

US 2021/0148169 A1 May 20, 2021

(51) Int. Cl.
*E06C 7/14* (2006.01)

(52) U.S. Cl.
CPC ..... *E06C 7/14* (2013.01)

(58) Field of Classification Search
CPC ... E06C 7/08; E06C 7/14; E06C 7/143; E06C 7/07
See application file for complete search history.

(56) References Cited

U.S. PATENT DOCUMENTS

| | | | | |
|---|---|---|---|---|
| 4,613,042 | A * | 9/1986 | Aeschliman | E06C 7/14 206/372 |
| 5,749,437 | A * | 5/1998 | Weller | E06C 7/14 182/129 |
| 6,116,419 | A * | 9/2000 | Campagna | E06C 7/14 182/129 |
| 6,536,590 | B1 * | 3/2003 | Godshaw | B25H 3/00 206/373 |
| 6,698,699 | B1 | 3/2004 | Bailey | |
| 7,114,592 | B1 | 10/2006 | Gibson | |
| 7,828,119 | B1 * | 11/2010 | Schirado | F16N 5/02 184/105.2 |
| 8,636,145 | B1 | 1/2014 | Toleski | |
| 9,702,191 | B2 * | 7/2017 | Mikesell, Sr. | E06C 7/14 |
| D810,320 | S | 2/2018 | Rose | |
| 2002/0070137 | A1 * | 6/2002 | Hedges | E06C 1/397 206/373 |
| 2006/0006024 | A1 | 1/2006 | Till | |

* cited by examiner

*Primary Examiner* — Amy J. Sterling

(57) ABSTRACT

A ladder tool storage kit for storing tools on a ladder includes a magnet that is elongated along a longitudinal axis. The magnet is mountable to a respective leg of a ladder to magnetically engage ferromagnetic tools for storage. A tube is mountable to a respective leg of the ladder to insertably receive tools for storage. A storage pouch is attached to a respective leg of the ladder to receive tools for storage.

9 Claims, 4 Drawing Sheets

LADDER TOOL STORAGE KIT

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to storage kits and more particularly pertains to a new storage kit for storing tools on a ladder.

(2) Description of Related Art Including Information Disclosed Under 37 CFR 1.97 and 1.98

The prior art relates to storage kits. The prior art discloses storage devices that can be clamped to a ladder for storing tools. Additionally, the prior art discloses a retainer that releasably engages a paint can on a ladder. The prior art discloses a magnetic tool holder that is positioned on top of a top rung of a ladder. The prior art also discloses a ladder that has a magnetic top rung for magnetically storing tools. A variety of storage caddies are disclosed, each having a plurality of compartments integrated therein for storing a variety of tools on a ladder. Moreover, the caddies are generally suspended from the top rung of the ladder.

(h) BRIEF SUMMARY OF THE INVENTION

An embodiment of the disclosure meets the needs presented above by generally comprising a magnet that is elongated along a longitudinal axis. The magnet is mountable to a respective leg of a ladder to magnetically engage ferromagnetic tools for storage. A tube is mountable to a respective leg of the ladder to insertably receive tools for storage. A storage pouch is attached to a respective leg of the ladder to receive tools for storage.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
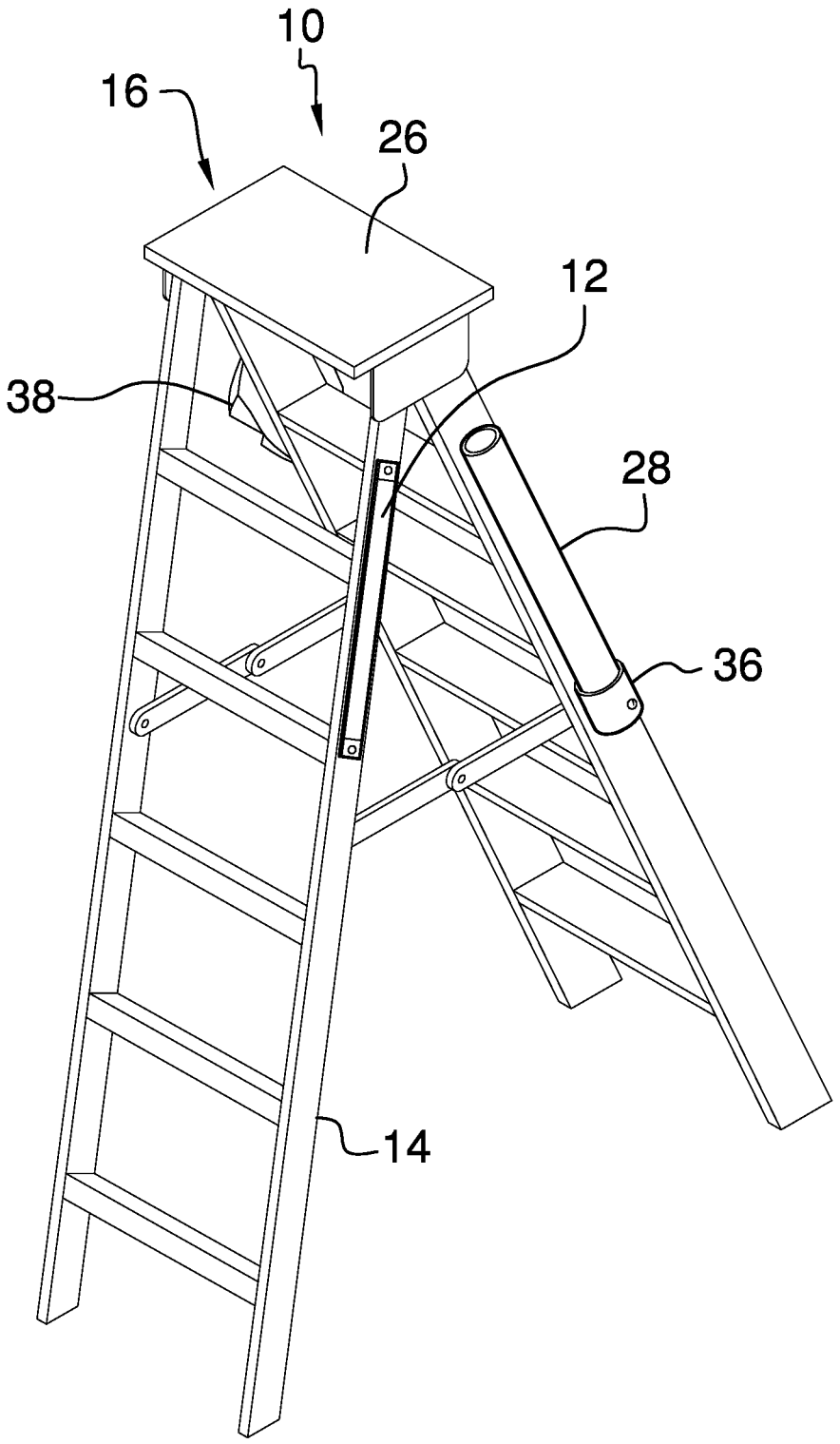
FIG. 1 is a perspective view of a ladder tool storage kit according to an embodiment of the disclosure.
Figure 2:
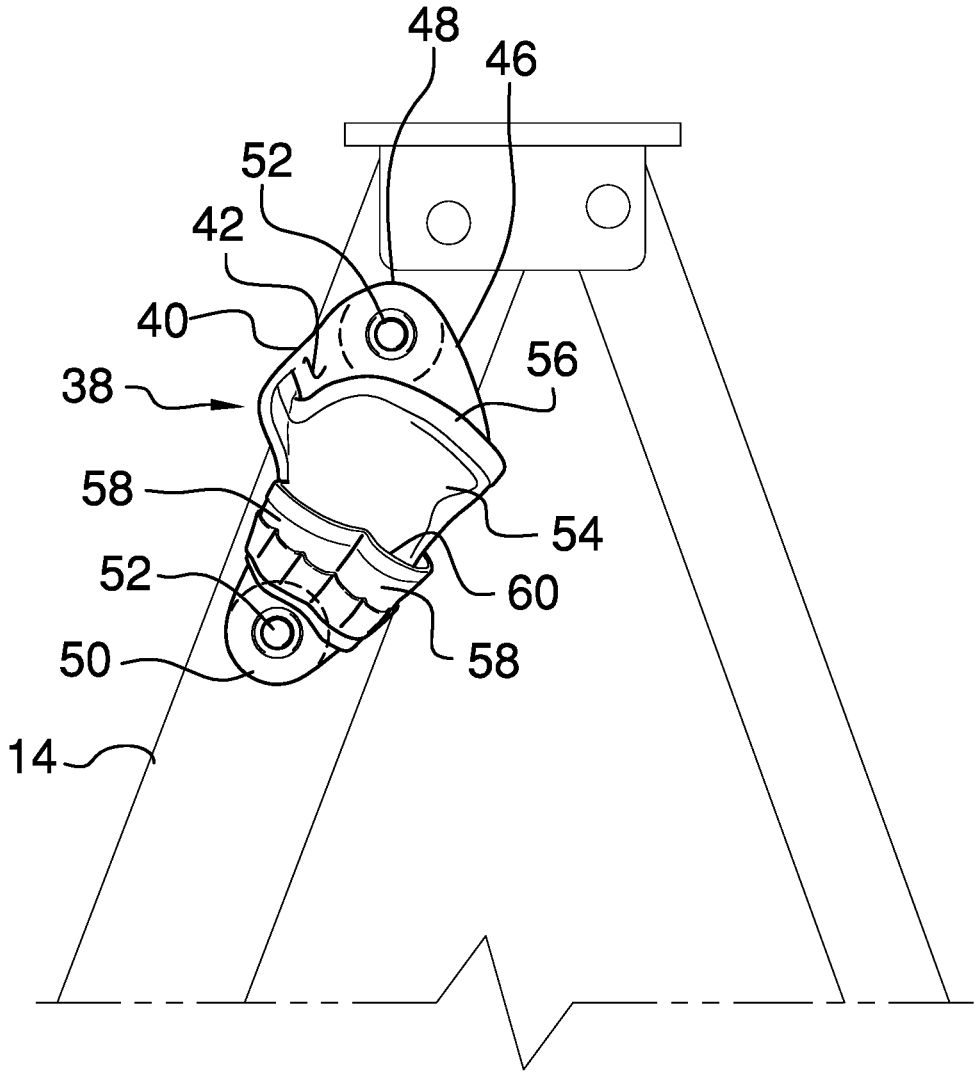
FIG. 2 is a perspective view of a storage pouch of an embodiment of the disclosure.
Figure 3:
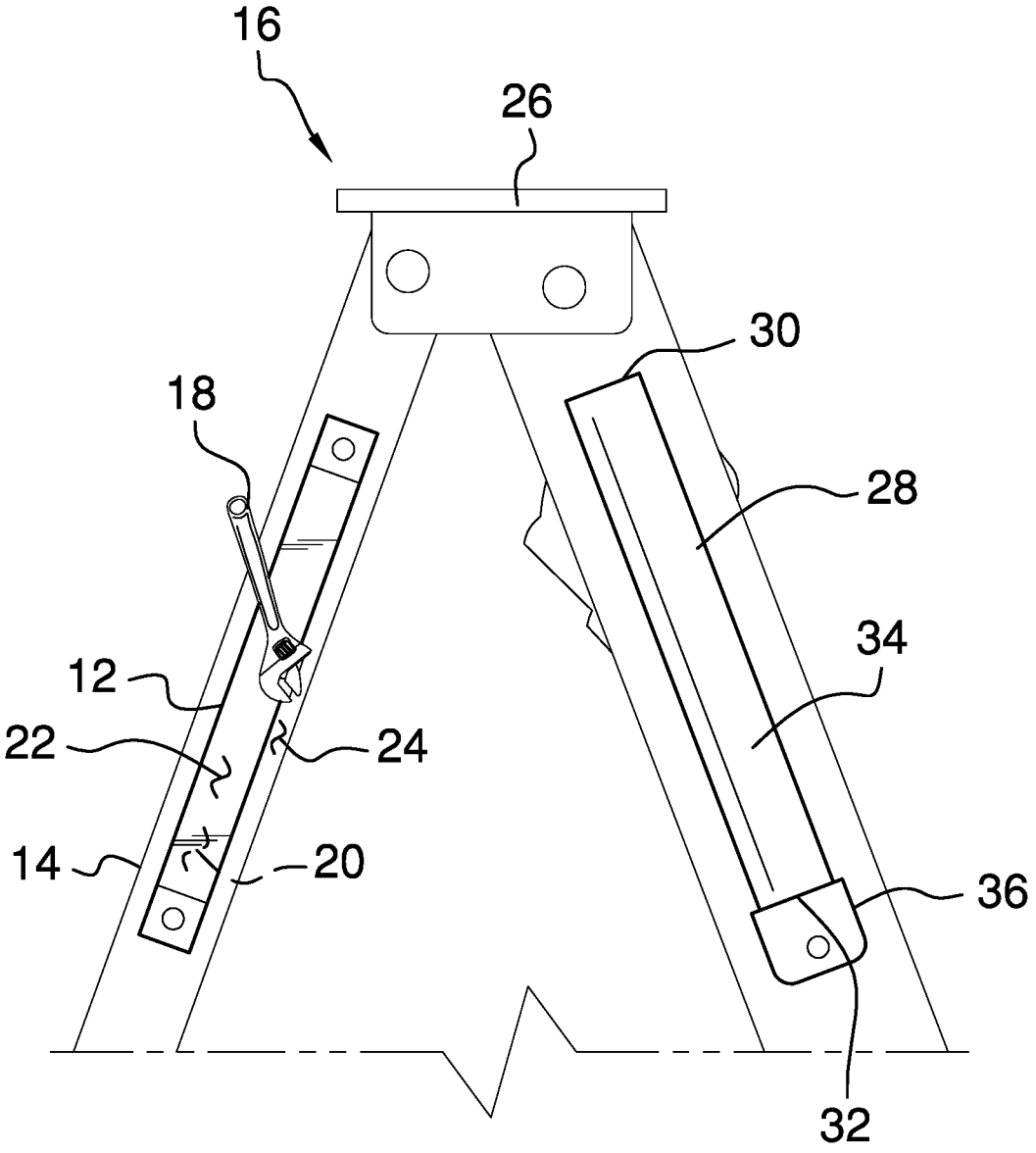
FIG. 3 is a perspective view of a magnet and a tube of an embodiment of the disclosure.
Figure 4:
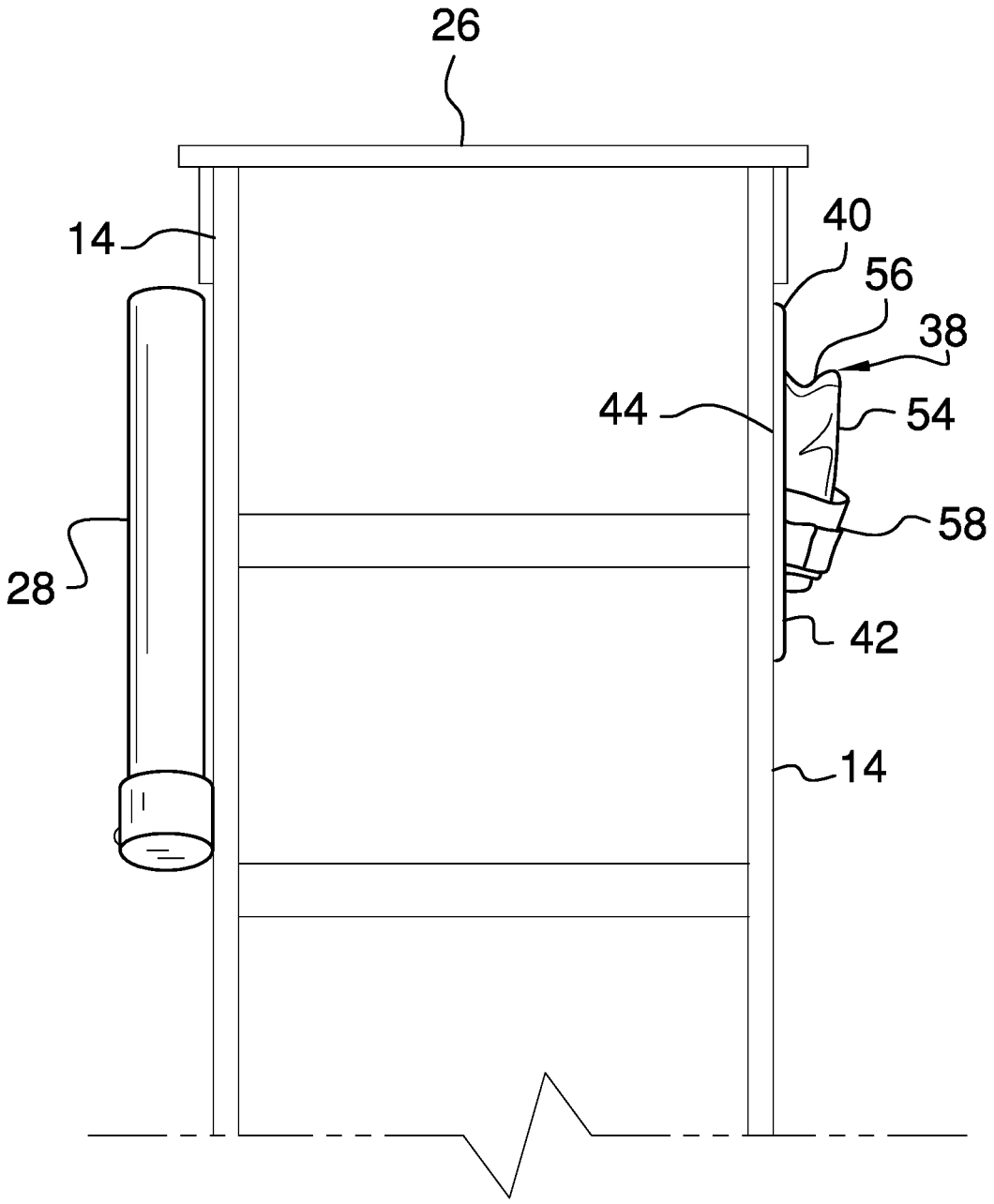
FIG. 4 is a front view of an embodiment of the disclosure.

With reference now to the drawings, and in particular to FIGS. 1 through 4 thereof, a new storage kit embodying the principles and concepts of an embodiment of the disclosure and generally designated by the reference numeral 10 will be described.

As best illustrated in FIGS. 1 through 4, the ladder tool storage kit 10 generally comprises a magnet 12 that is elongated along a longitudinal axis. The magnet 12 is mountable to a respective leg 14 of a ladder 16 to magnetically engage ferromagnetic tools 18 for storage. In this way the ferromagnetic tools 18 are available to a user standing on the ladder 16. The ladder 16 may be a step ladder of any height or design. The magnet 12 has a first surface 20 and a second surface 22, and the first surface 20 is attached to an outwardly facing surface 24 of the respective leg 14. The magnet 12 is positioned adjacent to a top rung 26 of the ladder 16 such that the magnet 12 is accessible to a user who is standing on the ladder 16. Additionally, the magnet 12 is oriented collinear with the respective leg 14 and the magnet 12 may have a length of at least 18.0 inches.

A tube 28 is provided and the tube 28 is mountable to a respective leg 14 of the ladder 16 to insertably receive tools for storage. The tube 28 has a first end 30, a second end 32 and an outer wall 34 extending therebetween. The outer wall 34 is attached to an outwardly facing surface 24 of the respective leg 14. Additionally, the tube 28 is positioned adjacent to the top rung 26 of the ladder 16 such that the tube 28 is accessible to the user standing on the ladder 16. The tube 28 is oriented collinear with the respective leg 14. A cap 36 is coupled to the second end 32 of the tube 28 to close the second end 32 for retaining the tools in the tube 28. The tube 28 may have a length ranging between approximately 15.0 inches and 20.0 inches and the tube 28 may have a diameter ranging between approximately 1.25 inches and 2.5 inches.

A storage pouch 38 is provided and the storage pouch 38 is attached to a respective leg 14 of the ladder 16 to receive tools for storage. The storage pouch 38 comprises a panel 40 that has a first surface 42, a second surface 44 and a perimeter edge 46 extending therebetween. The perimeter edge 46 is arcuate about a center point of the panel 40. The panel 40 is elongated between an upper end 48 and a lower end 50 of the panel 40 such that the panel 40 has an ovoid shape. Additionally, the second surface 44 of the panel 40 is positioned against the respective leg 14 of the ladder 16.

The storage pouch 38 includes a pair of fasteners 52 is that each extends through the first surface 20 and the second surface 22 of the panel and engages the respective leg 14 of the ladder 16. In this way the panel 40 is retained on the respective leg 14. Each of the fasteners 52 is aligned with a respective one of the upper end 48 and the lower end 50. A first pocket 54 is coupled to the first surface 20 of the panel, the first pocket 54 has a top end 56 and the top end 56 is open for receiving tools.

A plurality of second pockets 58 is each coupled to the first pocket 54. Each of the second pockets 58 has a top end 60 and the top end 60 of each of the second pockets 58 is open for receiving tools. Moreover, the top end 60 of each of the second pockets 58 is spaced downwardly from the top end 56 of the first pocket 54. The storage pouch 38 may be a cordless drill pouch or the like and the first pocket 54 may have dimensions sufficient to accommodate a cordless drill.

In use, the ferromagnetic tools 18, such as wrenches, screwdrivers or any other similar hand tools, are stored on the magnet 12 while the user is standing on the ladder 16. In this way the ferromagnetic tools 18 are available without requiring the user to wear a tool belt or the like. Other elongated, non-ferromagnetic tools, including but not being limited to a paint roller handle or a shovel handle, can be stored in the tube 28. A cordless drill or other types of tools can be stored in the storage pouch 38. In this way a large variety of tools can be stored in a location that is easily accessible when the user is standing on the ladder 16.

With respect to the above description then, it is to be realized that the optimum dimensional relationships for the parts of an embodiment enabled by the disclosure, to include variations in size, materials, shape, form, function and manner of operation, kit and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A ladder tool storage kit being configured to be mounted to a ladder for storing a variety of tools, said kit comprising:

a magnet being elongated along a longitudinal axis, said magnet being mounted to a respective leg of a ladder such that said magnet extends along the respective leg of the ladder spaced from a top of the ladder wherein said magnet is configured to magnetically engage ferromagnetic tools for storage;

a tube being mountable to a respective leg of the ladder wherein said tube is configured to insertably receive tools for storage; and a storage pouch being attached to a respective leg of the ladder wherein said storage pouch is configured to receive tools for storage.

2. The kit according to claim 1, wherein said magnet has a first surface and a second surface, said first surface being attached to an outwardly facing surface of the respective leg, said magnet being positioned adjacent to a top rung of the ladder wherein said magnet is configured to be accessible to a user who is standing on the ladder, said magnet being oriented collinear with the respective leg.

3. The kit according to claim 1, wherein said tube has a first end, a second end and an outer wall extending therebetween, said outer wall being attached to an outwardly facing surface of the respective leg, said tube being positioned adjacent to the top rung of the ladder wherein said tube is configured to be accessible to the user standing on the ladder, said tube being oriented collinear with the respective leg.

4. The kit according to claim 3, further comprising a cap being coupled to said second end of said tube for closing said second end wherein said cap is configured to retain the tools in said tube.

5. The kit according to claim 1, wherein said storage pouch comprises a panel having a first surface, a second surface and a perimeter edge extending therebetween, said perimeter edge being arcuate about a center point of said panel, said panel being elongated between an upper end and a lower end of said panel such that said panel has an ovoid shape, said second surface being positioned against the respective leg of the ladder.

6. The kit according to claim 5, further comprising a pair of fasteners, each of said fasteners extending through said first surface and said second surface of said panel and engaging the respective leg of the ladder to retain said panel on the respective leg, each of said fasteners being aligned with a respective one of the upper end and the lower end.

7. The kit according to claim 6, further comprising a first pocket being coupled to said first surface of said panel, said first pocket having a top end, said top end being open for receiving tools.

8. The kit according to claim 7, further comprising a plurality of second pockets, each of said second pockets being coupled to said first pocket, each of said second pockets having a top end, said top end of each of said second pockets being open for receiving tools, said top end of each of said second pockets being spaced downwardly from said top end of said first pocket.

9. A ladder tool storage kit being configured to be mounted to a ladder for storing a variety of tools, said kit comprising:

a magnet being elongated along a longitudinal axis, said magnet being mounted to a respective leg of a ladder such that said magnet extends along the respective leg of the ladder spaced from a top of the ladder wherein said magnet is configured to magnetically engage ferromagnetic tools for storage, said magnet having a first surface and a second surface, said first surface being attached to an outwardly facing surface of the respective leg, said magnet being positioned adjacent to a top rung of the ladder wherein said magnet is configured to be accessible to a user who is standing on the ladder, said magnet being oriented collinear with the respective leg;

a tube being mountable to a respective leg of the ladder wherein said tube is configured to insertably receive tools for storage, said tube having a first end, a second end and an outer wall extending therebetween, said outer wall being attached to an outwardly facing surface of the respective leg, said tube being positioned adjacent to the top rung of the ladder wherein said tube is configured to be accessible to the user standing on the ladder, said tube being oriented collinear with the respective leg;

a cap being coupled to said second end of said tube for closing said second end wherein said cap is configured to retain the tools in said tube; and a storage pouch being attached to a respective leg of the ladder wherein said storage pouch is configured to receive tools for storage, said storage pouch comprising:

a panel having a first surface, a second surface and a perimeter edge extending therebetween, said perimeter edge being arcuate about a center point of said panel, said panel being elongated between an upper end and a tower end of said panel such that said panel has an ovoid shape, said second surface being positioned against the respective leg of the ladder;

a pair of fasteners, each of said fasteners extending through said first surface and said second surface of said panel and engaging the respective leg of the ladder to retain said panel on the respective leg, each of said fasteners being aligned with a respective one of the upper end and the lower end;

a first pocket being coupled to said first surface of said panel, said first pocket having a top end, said top end being open for receiving tools; and a plurality of second pockets, each of said second pockets being coupled to said first pocket, each of said second pockets having a top end, said top end of each of said second pockets being open for receiving tools, said top end of each of said second pockets being spaced downwardly from said top end of said first pocket.

* * * * *